US006128464A

United States Patent [19]

Taniguchi et al.

[11] Patent Number: 6,128,464

[45] Date of Patent: Oct. 3, 2000

[54] APPARATUS FOR REMOVING PRINTING MATERIAL FROM A RECORDING MEMBER ON WHICH AN IMAGE IS RECORDED BY THE PRINTING MATERIAL

[75] Inventors: Kazuko Taniguchi, Takatsuki; Naoki Yoshie, Kyoto, both of Japan

[73] Assignee: Minolta Co., Ltd., Osaka, Japan

[21] Appl. No.: 09/057,475

[22] Filed: Apr. 9, 1998

[30] Foreign Application Priority Data

| | | | |
|---|---|---|---|
| Apr. 10, 1997 | [JP] | Japan | 9-092298 |
| Jan. 20, 1998 | [JP] | Japan | 10-008420 |
| Jan. 20, 1998 | [JP] | Japan | 10-008421 |

[51] Int. Cl.[7] ..... G03G 21/00

[52] U.S. Cl. ..... 399/381; 15/102; 156/584

[58] Field of Search ..... 399/381, 123, 399/343, 357; 156/247, 281, 289, 584, 344, 390; 15/102

[56] References Cited

U.S. PATENT DOCUMENTS

| | | | |
|---|---|---|---|
| 5,006,189 | 4/1991 | Tsukamoto et al. . | |
| 5,353,108 | 10/1994 | Tsukamoto . | |
| 5,642,550 | 7/1997 | Maruyama et al. | 15/102 |
| 5,643,380 | 7/1997 | Saitoh et al. | 156/94 |
| 5,855,734 | 1/1999 | Saito et al. | 156/584 |

FOREIGN PATENT DOCUMENTS

| | | |
|---|---|---|
| 04116000 | 4/1992 | Japan . |
| 5-232737 | 9/1993 | Japan . |
| 07084489 | 3/1995 | Japan . |
| 07084490 | 3/1995 | Japan . |
| 7-084489 | 3/1995 | Japan . |
| 7-311522 | 11/1995 | Japan . |
| 8-146844 | 6/1996 | Japan . |

*Primary Examiner*—Quana Grainger
*Attorney, Agent, or Firm*—McDermott, Will & Emery

[57] ABSTRACT

An apparatus according to the present invention removes printing material from a recording member on which an image is recorded by the printing material. The apparatus includes a releasing member and a separation member. The releasing member comes into pressure contact with the recording member and adheres to the printing material on the recording member. The separation member separates the recording member from the releasing member at a separation point and releases the printing material from the recording member by bending the releasing member and the recording member in mutually opposite directions so as to make the radius of curvature of the recording member smaller than the radius of curvature of the releasing member.

20 Claims, 11 Drawing Sheets

APPARATUS FOR REMOVING PRINTING MATERIAL FROM A RECORDING MEMBER ON WHICH AN IMAGE IS RECORDED BY THE PRINTING MATERIAL

This application based on applications Nos. 9-92298, 10-8420 and 10-8421 filed in Japan, the contents of which are hereby incorporated by reference.

BACKGROUND OF THE INVENTION

The present invention relates to an apparatus for removing printing material on a recording member recorded by an electro-photographic system.

Conventionally, there has been proposed, from the viewpoint of paper recycling, an apparatus for removing printing material on a recording member recorded by an electro-photographic system. In the apparatus, a heat-melting releasing member is brought into contact with the recording member and heated. Then the releasing member is cooled and separated from the recording member, thereby the printing material on the recording member is released and transferred onto the releasing member.

For example, FIG. 16 of Japanese Laid-open Patent Publication No. 1-297294 (1989) discloses an apparatus arranged such that a plane part of the belt forming releasing member 201 is brought into pressure contact with a recording member 202, and the recording member 202 is moved in curved state around the roller 203 to make separation. In such apparatus, there is a drawback that the recording member 202 is not satisfactorily separated from the releasing member 201 when the timing for curving the recording member 202 disagrees.

In Japanese Laid-open Patent Publications No. 4-94958 (1992) and No. 4-116000 (1992), there is disclosed an apparatus as shown in FIG. 17. In the apparatus, a recording member is passed between a releasing member roller 204 and a heating roller 205 which are disposed opposite to each other to remove printing material 202*a* from the recording member 202. In such apparatus, because the recording member 202 is separated from the releasing member roller 204 without being sufficiently cooled, there are problems that the printing material 202*a* remains on the recording member 202 or the resin layer of the releasing member roller 204 is transferred to the recording member 202.

Furthermore, in Japanese Laid-open Patent Publications No. 7-84489 (1995) and No. 7-84490 (1995), there is disclosed an apparatus as shown in FIG. 18. In the apparatus, a recording member 202 is passed between a small diameter releasing roller 206 and a backup roller 207 which are disposed opposite to each other. Then, as shown in two dots chain lines the recording member 202 which is; apt to be discharged in a state of adhering to the releasing roller 206 is separated from the releasing roller 206 due to its own resilience. In the apparatus, the separation performance of the recording member 202 from the releasing roller 206 depends on the resilience of the recording member 202. Therefore, there is an apprehension that the recording member 202 cannot be removed from the releasing roller 206 depending on the kind of the recording member 202.

When the printing material 202*a* is removed by the conventional apparatuses as described above, depression and protrusion are created as shown in FIGS. 19A and 19*b* between part where the printing material 202*a* is fixed and part where it is not fixed. The depression and protrusion make image traces, causing a possibility that the image would be read out and secret information would be leaked when the recording member 202 is a secret document.

In addition, in the case that image is formed on both surfaces of the recording member 202, while treating one surface of the recording member 202, the printing material on the other non-treated surface adheres to the rollers 203, 205 and 207 and conveying belts (unshown) because of the heating treatment of the recording member 202. As a result, the surface of the next recording material to be subsequently treated is soiled with the printing material adhered to the roller 203 and so on.

SUMMARY OF THE INVENTION

The present invention has been developed to substantially eliminate the above-described disadvantages.

It is therefore an object of the present invention to provide a printing material removing apparatus in which a recording member can be favorably separated from a releasing member and printing material on the recording member can be reliably released.

It is an another object of the present invention to prevent the image traces from clearly remaining on the recording member after removing the printing material.

It is an another object of the present invention to provide a printing material removing apparatus in which the printing material does not adhere to the roller and so on, and even though the printing material adhered, it can be easily cleaned.

In order to solve the first object, there is provided an apparatus for removing printing material from a recording member on which an image is recorded by the printing material, comprising:

a releasing member which comes into pressure contact with the recording member and adheres to the printing material on the recording member; and a separation member for separating the recording member from the releasing member at a separation part to release the printing material from the recording member by bending the releasing member and the recording member in mutually opposite directions so as to make the radius of curvature of the recording member smaller than the radius of curvature of the releasing remember.

The releasing member is preferably a material having high adhesion property to the printing material on the recording member. For example, resin, metal, and the like may be used. In general, the adhesion property between resin materials correlates with their inherent SP values (solubility parameters). The materials whose SP values are proximate are highly adhesive to each other. Since the acrylic resin and the polyester resin which are the main component of the printing material have the SP values of 9 to 11, it is especially preferable to use a resin material having a SP value of 8 to 12 as the releasing material of the present invention.

Also, the above releasing member is preferably brought into pressure contact with the recording member under heated condition. As the heating means, there can be used a contact type heating roller, a non-contact type infrared ray heater, and the like. The heating temperature by this heating means may be higher than the temperature at which the released printing material on the releasing member is softened and lower than the temperature which is determined from the heat resistance of the recording member. Preferably the heating temperature is in the range between 80° C. and 200° C.

In the printing material removing apparatus of the present invention, because both the releasing member and the recording member are curved, the recording member which tends to move in a state of being adhered to the curved releasing member has a releasing force. The releasing force causes the recording member to be separated from the releasing member based on its own resilience. In addition to this, due to the bending stress exerted to the outer surface of the curved recording member, a shear force acts between the outer surface of the recording member and the printing member. By these releasing force and shear force, the recording member is favorably separated from the releasing member, and the printing material on the recording member is released from the recording member. Because of this, remaining of the printing material on the recording member or transfer of the releasing member to the recording member can be prevented.

Preferably, the ratio between the radius of curvature R1 of the recording member at the separation part and the radius of curvature R2 of the releasing member at the separation part is 1:10 to 8:10.

Preferably, the releasing member comprises a belt-like member borne on a plurality of rollers, the separation member comprises a separation roller opposed to the one of the plurality of rollers, and the separation roller has a smaller diameter than the one of the plurality of rollers. Whereby, when the belt-like member rotates, the recording member moves along the belt-like member, passes through a opposed part between the belt-like member and the separation roller, and moves around the separation roller.

Alternatively, the releasing member may comprise a drum-like member, the separation member may comprise a separation roller opposed to the drum-like member, and the separation roller may have a smaller diameter than the drum-like member. Whereby, when the drum-like member rotates, the recording member moves along the drum-like member, passes through a opposed part between the drum-like member and the separation roller, and moves around the separation roller.

Preferably, the releasing member has a plural layers constitution comprising a base layer and a surface layer provided on the base layer, the surface layer is made of a material adhereable to the printing material. In this case, the surface layer of the releasing member is preferably the same material as that of the printing material.

Alternatively, the releasing member may have a single layer constitution. In this case, the releasing member is preferably metal.

In order to solve the second object, the apparatus according to the present invention further comprises an image traces unvisualizing means for unvisualizing an image traces after removing the printing material. The image traces unvisualizing means is preferably a roller which comes into contact with the recording member. In this case, the surface of the roller may have roughness or may be smooth. The roller is preferably a heating roller.

Alternatively, the image traces unvisualizing means may be roughness formed on the releasing member.

In order to solve the third object, the apparatus according to the present invention further comprises a backup member provided so as to face to the opposite surface to the treating surface of the recording member, the surface of the backup member comprising a releasable material. In this case, the backup member may be a roller or a guide for guiding the recording member to the separation part. A cleaning means for removing the adhesion material on the roller can be provided.

The present invention is also directed to a method for removing printing material from a recording member on which an image is recorded by the printing material, comprising the steps of:

making a releasing member come into pressure contact with the recording member to make it adhere to the printing material on the recording member; and separating the recording member from the releasing member at a separation part to release the printing material from the recording member by bending the releasing member and the recording member in mutually opposite directions so as to make the radius of curvature of the recording member smaller than the radius of curvature of the releasing member.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

First Embodiment

Figure 1:
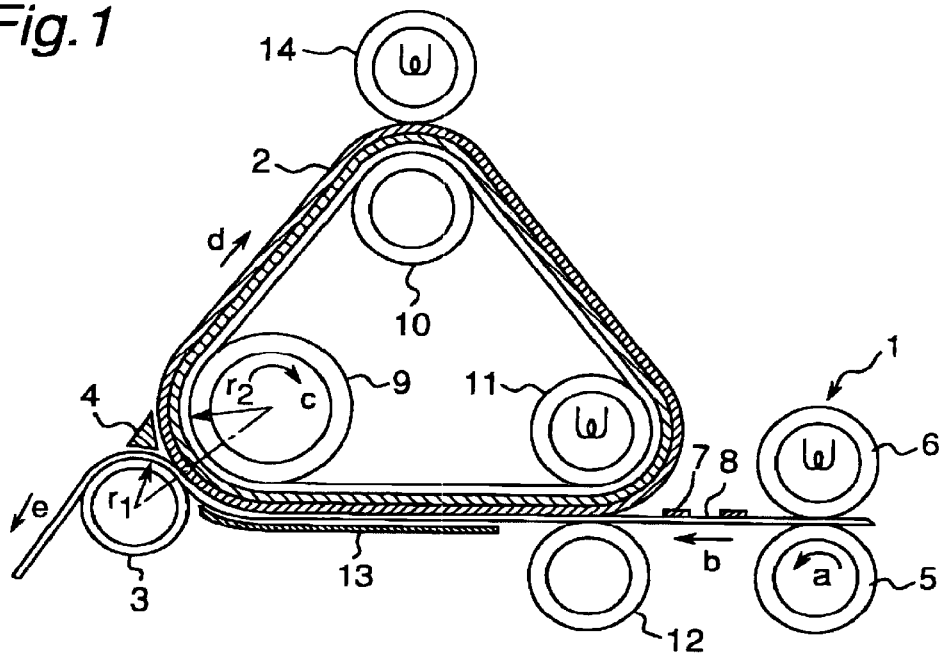
FIG. 1 is a view showing a first embodiment of the printing material removing apparatus according to the present invention.

FIG. 1 shows a first embodiment of the printing material removing apparatus of the present invention. This apparatus comprises a paper feed roller 1, a releasing belt 2, a separation roller 3, and a separation claw 4.

The paper feed roller 1 comprises a driving roller 5 for driving in rotation in the direction of arrow "a", and a driven and heating roller 6 (hereinafter to be simply referred to as heating roller). The heating roller is disposed above the driving roller 5 and in pressure contact with and opposite to the driving roller 5. The paper feed roller 1 can supply a recording member 8, on which printing material 7 is fixed to form a picture image, in the state of the printing material 7 disposed above, horizontally toward the releasing belt 2 to be described later, in the direction of arrow "b". The heating roller 6 is to heat the printing material 7 of the recording member 8 to be supplied. The heating temperature is set at a level between 80° C. and 200° C. Instead of using the heating roller 6, there may be disposed on the downstream side of the paper feed roller 1 an infrared heater or the like. The infrared heater heats the printing material 7 on the recording member 8 supplied by the paper feed roller 1 without contacting the recording member 8.

The releasing belt 2 is borne on a driving roller 9, a driven roller 10 and a heating roller 11 which are disposed in triangle relations. The releasing belt 2 is movable in the direction of arrow "d" according to the rotation of the driving roller 9 in the direction of arrow "c". Underneath the heating roller 11 there is disposed a backup roller 12 in a manner to be in pressure contact with the releasing belt 2 opposite to the heating roller 11. Also, a guide plate 13 is disposed in the vicinity of the belt part between the driving roller 9 and the heating roller 11. The heating roller 11 is to heat the later described releasing member surface layer 23 of the releasing belt 2 and also the printing material 7 of the supplied recording member 8. Hereinafter, the opposed part between the heating roller 11 and the backup roller 12 is referred to as a pressure contact part. The heating temperature by the heating roller 11 is set to be in the range between 80° C. and 200° C.

Above the driven roller 10 of the releasing belt 2 there is disposed a heating roller 14 in a manner to be brought into pressure contact with the releasing belt 2 opposite to the driven roller 10. The heating roller 14 is to heat and melt the printing material 7 on the releasing belt 2 released from the recording member 8. In place of the heating roller 14, there may be provided an infrared heater for heating the printing material 7 on the releasing belt 2, without contacting the recording member 8. The heating temperature by the heating roller 14 is set to be in the range between 80° C. and 200° C.

Figure 4:
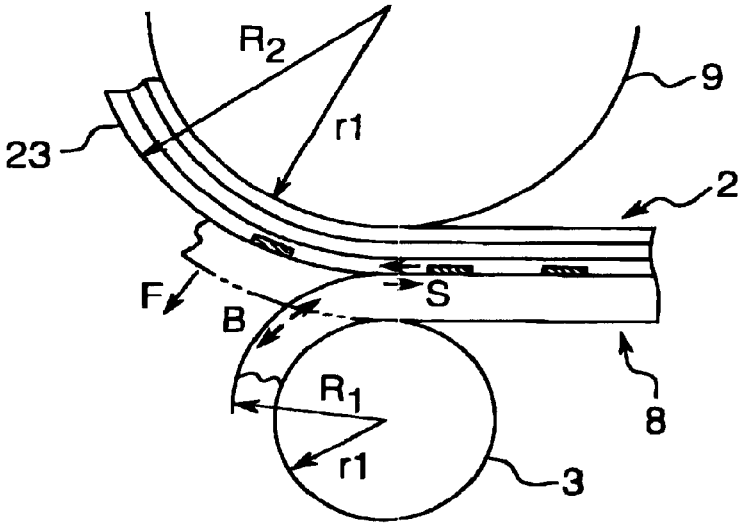
FIG. 4 is an enlarged view of the separation part.

The separation roller 3 is disposed obliquely below the driving roller 9 of the releasing belt 2 in a manner to be in pressure contact with the releasing belt 2 opposite to the driving roller 9. The radius r1 of the separation roller 3 is set to be smaller than the radius r2 of the driving roller 9. By this step, as shown in FIG. 4, the radius of curvature R1 of the recording member 8 which moves along the outer surface of the separation roller 3 is smaller than the radius of curvature R2 of the surface layer 23 of the releasing belt 2 moving around the driving roller 9.

Preferred range of ratios between the radius of curvature R1 and the radius of curvature R2 is 1:10 to 8:10. If the ratio is too small, then the apparatus becomes too large, and if too large, then sufficient separation is not obtained.

The separation claw 4 is disposed on the exit side between the separation roller 3 and the driving roller 9 of the releasing belt 2 (hereinafter, this portion is referred to as separation part). This separation claw 4 is provided for separating the recording member 8 from the releasing belt 2 and discharging it along the surface of the separation roller 3.

The recording member 8 to be treated by the printing material removing apparatus comprising the above constitution comprises a transparent plastic film (OHP sheet and the like) or a film (synthetic paper) which is made opaque by addition of inorganic fine particles. The recording member is formed with an image of the printing material 7 thereon by an appropriate image forming apparatus, as shown in FIG. 2(B). The plastic film is not specifically limited if it is a thermoplastic resin, but considering the heat resistance, the suitable ones are of polyester, polycarbonate, polyimide, polymethyl methacrylate, and the like. Of those, polyester, and especially polyethylene terephthalate is preferable in view of the universal applicability, price, heat resistance, durability, etc.

The printing material 7 which is recorded as an image in the recording member 8 is a so-called toner (hereinafter, the printing material is to be referred to as toner). The toner generally comprises acrylic (methacryl) polymer, acrylic (methacryl)-styrene copolymer, or polyester polymer as the main component, with addition of coloring agent, releasing agent, antistatic agent, etc. thereto.

Figure 2A:
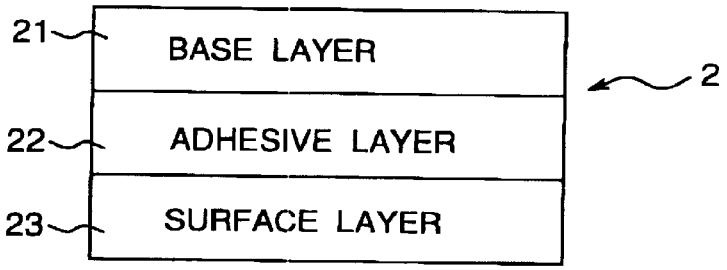
FIGS. 2A and 2B are schematic views showing the structure of the recording member and the releasing member respectively.
Figure 2B:
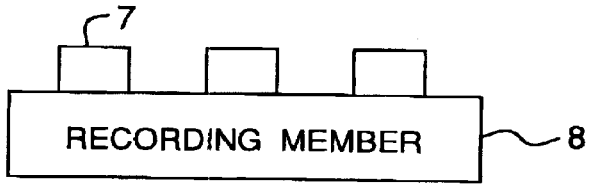

The releasing belt 2 comprises, as shown in FIG. 2A, a base layer 21, a adhesive layer 22 and a surface layer 23 provided on the base layer 21 through the adhesive layer 22.

The releasing member surface layer 23 is provided so as to release the toner 7 on the recording member 8. Namely, heat is applied to the toner 7 on the recording member 8 to soften the toner 7 and heat is also applied to the releasing member surface layer 23 to soften, then the toner 7 on the recording member 8 is caused to adhere to the releasing member surface layer 23. The lower limit of the temperature to be applied to the toner 7 is determined by the temperature at which the toner 7 is softened, and its upper limit is determined based on the heat resistance of the recording member 8. Substantially, the temperature to be applied to the toner is in the range between 80° C. and 200° C. Thus, by softening the toner 7 and also making the releasing member surface layer 23 softened state, adhesion of the toner 7 to the releasing member surface layer 23 is facilitated. For this reason, it is desirable that the releasing member surface layer 23 is thermoplastic resin having the softening point between 80° C. and 200° C. Especially, it is preferable that the softening point of the releasing member surface layer 23 is in the range of ±20° C. of the softening point of the toner. The softening point herein means the outflow starting temperature with the flow tester.

It is the essential conditions for the releasing member surface layer 23 to have good adhesive property to the toner 7. In other words, it is desirable for the material constituting the releasing member surface layer 23 to have high compatibility with the toner 7. In general, the compatibility between the different materials depends on the differences of the surface energies and SP values (solubility parameter). The materials whose SP values are close to each other show good compatibility. The SP value of the toner is variable by the kind of the resin which is the main component thereof, and it is approximately 9 to 11. The present inventors specially noted the SP value and made strenuous study of it. As a result, it has been found that when the SP value of the resin of the releasing member surface layer 23 is in the range between 8 and 12, the toner 7 on the recording member 8 is favorably transferred to the releasing member surface layer 23.

Examples of the resins having the softening points at 80–200° C., and SP value of 8–12 are polystyrene, styrene-acrylic (methacryl) copolymer, polyvinyl alcohol—vinyl acetate copolymer, polyvinyl acetal, polyester, and the like. Among these, styrene-acrylic (methacryl) copolymer, polyvinyl acetal, polyester resin, etc. are preferable from the viewpoint of the adhesion to toner, and the like.

On the other hand, the adhesive layer 22 is provided to cause the releasing member surface layer 23 to adhere to the base layer 21 and to prevent the transfer of the releasing member surface layer 23 to the recording member 8. With respect to the material to constitute the adhesive layer 22, the generally commercialized adhesives are given. Though the kinds of the adhesive are not particularly limited, there is required at least the adhesive having the heat resistance to a certain extent. Examples of the adhesive materials are vinyl/methyl ether, maleic anhydride copolymer, polyvinyl alcohol/vinyl acetate copolymer, vinyl acetal, ethyl acrylate, polyamide resin, phenol resin, resorcinol resin, polyester resin, epoxy resin, furan resin, polyurethane resin, chlorinated rubber, butadiene, acrylonitrile rubber, butyl rubber, neoprene rubber, thiokol, and the like, though not limited to them.

Figure 3A:
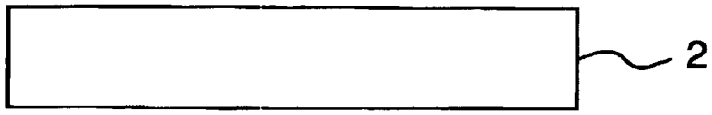
FIGS. 3A and 3B are schematic views showing other structure of the recording member and the releasing member.
Figure 3B:
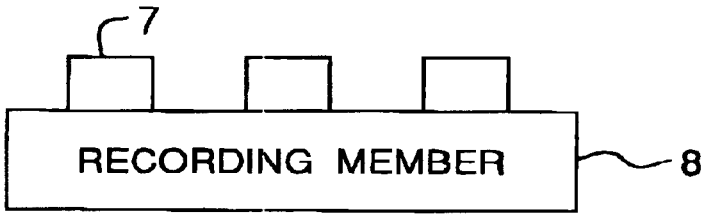

The method for applying the adhesive to the base layer 21 includes the chemical reaction method, heat melt method, solvent evaporation method, etc. It is preferable to take a suitable method depending on the kind of the adhesive. The surface layer 23 of the releasing member 2 is not necessarily a resin. Any material that can adhere the heated printing material may be used such as metals of Al, Ni, etc. and rubbers, without being limited to resin. This applies similarly to the case where the releasing belt 2 is of a single layer constitution as shown in FIG. 3A.

Next, the operation of the printing material removing apparatus comprising the above constitution will be described below.

When the recording member 8 on which the image is formed by the toner 7 is supplied to the paper feed roller 1 under the condition of the toner 7 being positioned on the upper part, the recording member 8 is transferred in the direction of arrow "b". The toner 7 is heated with the heating roller 6 and molten. By this step, the aggregation forces between the toners 7 on the recording member 8 show increase. The recording member 8 with the toner 7 heated is inserted in the gap between the releasing belt 2 and the backup roller 12. When the recording member 8 passes through the pressure contact part between the heating roller 11 and the backup roller 12, the heated releasing member surface layer 2 is brought into pressure contact with the recording member 8 to melt the toner 7 on the recording member 8. As a result, the toner 7 on the recording member 8 is fused with the releasing member surface layer 23. Thus the recording member 8 is further carried in the direction of arrow "b" under the condition of the toner 7 being fused with the releasing member surface layer 23. As the recording member 8 leaves the pressure contact part, the fused toner 7 and releasing member surface layer 23 are cooled and carried toward the separation part, while being solidified.

When the tip of the recording member 8 reaches the separation claw 4 after passing through the releasing belt 2 and the separation roller 3, the recording member 8 is separated from the releasing belt 2 by the separation claw 4. Then, the recording member 8 is bent in the direction opposite to the releasing member surface layer 23 of the releasing belt 2 by the separation roller 3, and discharged in the direction of arrow "e" along the periphery of the separation roller 3.

In the separation part, it should be noted that, as shown in FIG. 4, the radius of curvature R1 of the outer surface of the recording member 8 around the separation roller 3 is smaller than the radius of curvature R2 of the releasing member surface layer 23 of the releasing belt 2 around the driving roller 9. Because of this, the recording member 8 which has passed through the pressure contact part between the separation roller 2 and the driving roller 9 tends to move along the surrounding of the driving roller 9 under the condition of adhesion to the releasing member surface layer 23 of the releasing belt 2. However, as the releasing member surface layer 23 is curved in a radius of curvature R2, a separation force F which shows a tendency to be separated from the releasing member surface layer 23 works. Also, as the outer surface of the recording member 8 is curved in a radius of curvature R1, a bending stress B works on the outer surface thereof, so that based on this bending stress, a shear force S works on the interface between the recording member 8 and the printing material 7. Due to the separation force F and the shearing force S, the recording member 8 is easily separated from the releasing member surface layer 23, and the printing material 7 is surely released from the recording member 8 and transferred to the releasing member surface layer 23.

The releasing member surface layer 23 and the recording member 8 are both required to be separated at the temperature lower than 80° C. It is because, if the toner 7 is separated from the recording member 8 at the temperature higher than 80° C., strong force is necessary to release it, making the releasing difficult. Thereby, even if there may be provided the adhesive layer 22 between the release member surface layer 23 and the base layer 21, the releasing member surface layer 23 may be peeled at the interface with the adhesive layer 22 due to the strong releasing force and then transferred to the recording member 8. Accordingly, it is desirable to provide around the separation part with a heat insulation wall in a manner to surround the driving roller 9 of the releasing belt 2, separation roller 3 and separation claw 4 in order to maintain the separation part at a temperature lower than 80° C.

The toner 7 on the recording member 8 remains on the releasing member surface layer 23 in molten and solidified state by being released from the recording member 8 and transferred to the releasing member surface layer 23. Here, because, as described above, the toner 7 is heated in advance by the heating roller 6 to have increased aggregation force, it is securely released without showing discontinuance in the course of the release from the recording member 8 to the releasing member surface layer 23. The toner 7 transferred to the releasing member surface layer 23 moves in the direction of arrow "d" along with the releasing belt 2. When the toner 7 on the releasing member surface layer 23 reaches the opposite part to the heating roller 13, the toner 7 is heated by the heating roller 14. As a result, the aggregation force between the toners 7 becomes stronger and the adhesive force between the toner 7 and the releasing member surface layer 23 increases, preventing re-transfer to a recording member 8 to be supplied next.

Second Embodiment

Figure 5:
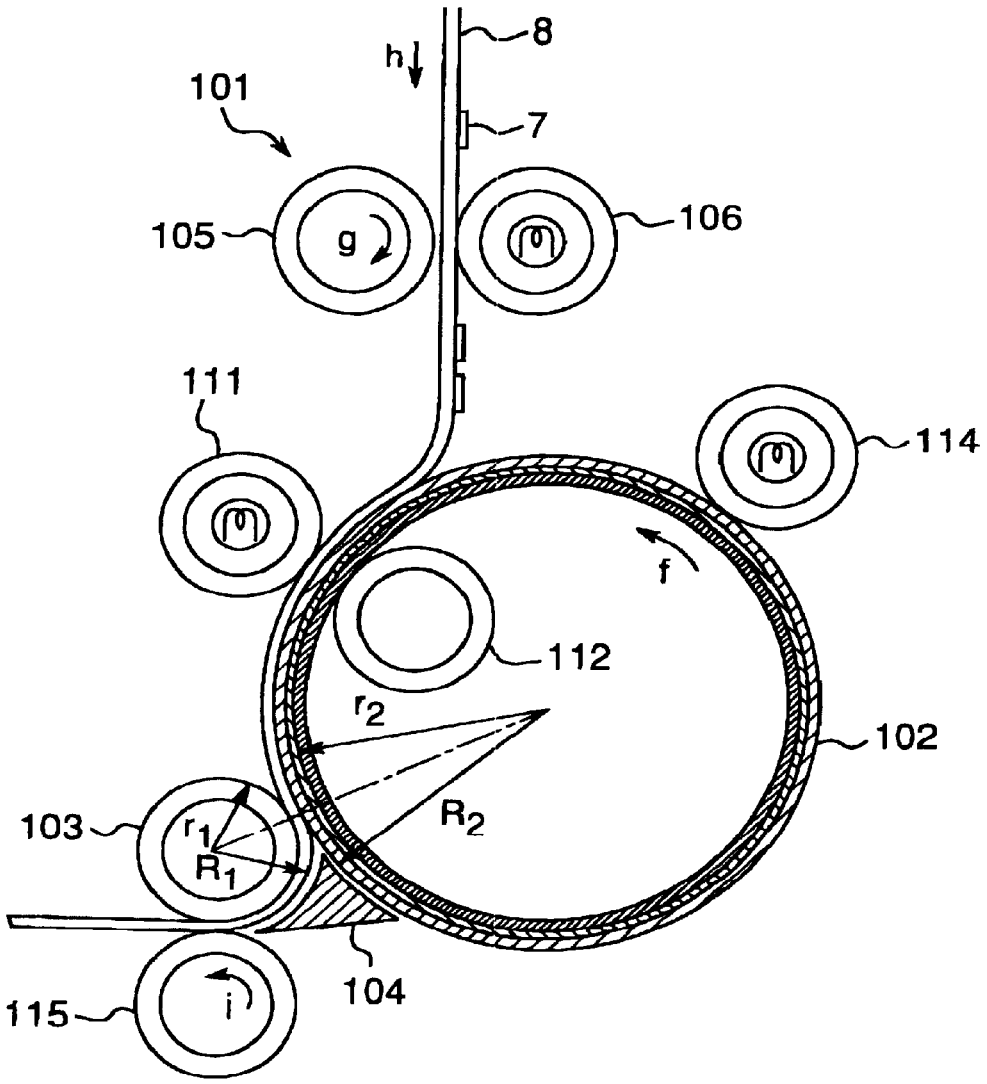
FIG. 5 is a view showing a second embodiment of the printing material removing apparatus of the present invention.

FIG. 5 shows a second embodiment of the printing material removing apparatus of the present invention.

In this embodiment, there is used a circular releasing drum 102 which rotates in the direction of arrow "f" by the non-illustrated driving apparatus. This releasing drum 102 has, in the same manner as in the first embodiment, preferably a releasing member surface layer 23 on the outer surface of the metal base layer 21 through the adhesive layer 22. Above the releasing drum 102 there is disposed a paper feed roller 101. This paper feed roller 101 comprises a driving roller 105 which is driven by rotation in the direction of arrow "g" and a heating roller 106 which is disposed opposite to and in pressure contact with the driving roller 105. Between the driving roller 105 and the heating roller 106, the recording member 8, on which printing material 7 is fixed to form a picture image, is inserted in the direction of arrow "h" with the printing material 7 faced to the heating roller 106, and then supplied toward the releasing drum 102 below. The heating roller 106 corresponds to the heating roller 6 of the embodiment shown in FIG. 1, and is designed to preheat the toner 7 of the recording member 8.

On the outer surface of the releasing drum 102, there is disposed in pressure contact a heating roller 111 for heating the recording member 8 which is carried on the releasing drum 102 (hereinafter this portion is referred to as a pressure contact part). Also, a backup roller 112 is disposed in a manner to be opposite to the heating roller 111 through the releasing drum 102 and the recording member 8. The heating roller 111 corresponds to the heating roller 11 of the embodiment shown in FIG. 1 and designed to bring the toner 7 of the recording member 8 and the releasing member surface layer 23 of the releasing drum 102 pressure contact with each other and heat them.

In a position distant by a predetermined distance from the pressure contact part to the downstream side in the direction of transfer of the recording member 8, a separation roller 103 and a separation claw 104 are disposed (hereinafter, this portion is referred as a separation part). These separation roller 103 and separation claw 104 correspond to the separation roller 3 and separation claw 4 in the embodiment of FIG. 1, which are designed to make separation between the releasing member surface layer 23 and the recording member 8. The radius r1 of the separation roller 103 is set to be smaller than the radius r2 of the releasing drum 102. Because of this, the radius of curvature R1 of the outer surface of the recording member 8 around the separation roller 103 is smaller than the radius of curvature R2 of the releasing member surface layer 23 of the releasing drum 102. Downward the separation roller 103, there is disposed a paper discharge roller 115 which is in pressure contact with and opposite to the separation roller 103 and driven in the direction of arrow "i".

On the downstream side in the transfer direction of the recording member 8 from the above separation part, there is disposed a heating roller 114 in pressure contact with the outer surface of the releasing drum 102. This heating roller 104 corresponds to the heating roller 14 of the embodiment shown in FIG. 1, which is to heat the toner 7 transferred to the releasing member surface layer 23.

The printing material removing apparatus comprising the above constitution shows the same operation as that of the printing material removing apparatus of the embodiment shown in FIG. 1, and therefore the explanation is omitted.

In the embodiments as described above, the releasing belt 2 and the releasing drum 102 may be provided with the means for cleaning the toner 7 fused to the releasing member surface layer 23. As the cleaning means, there may be used one which is to physically scrape off the toner 7 with a blade or one to thermally transfer to other members. By providing such cleaning means, the capacity for removing toner with the releasing member surface layer 23 can be maintained for a long period.

Third Embodiment

Figure 6:
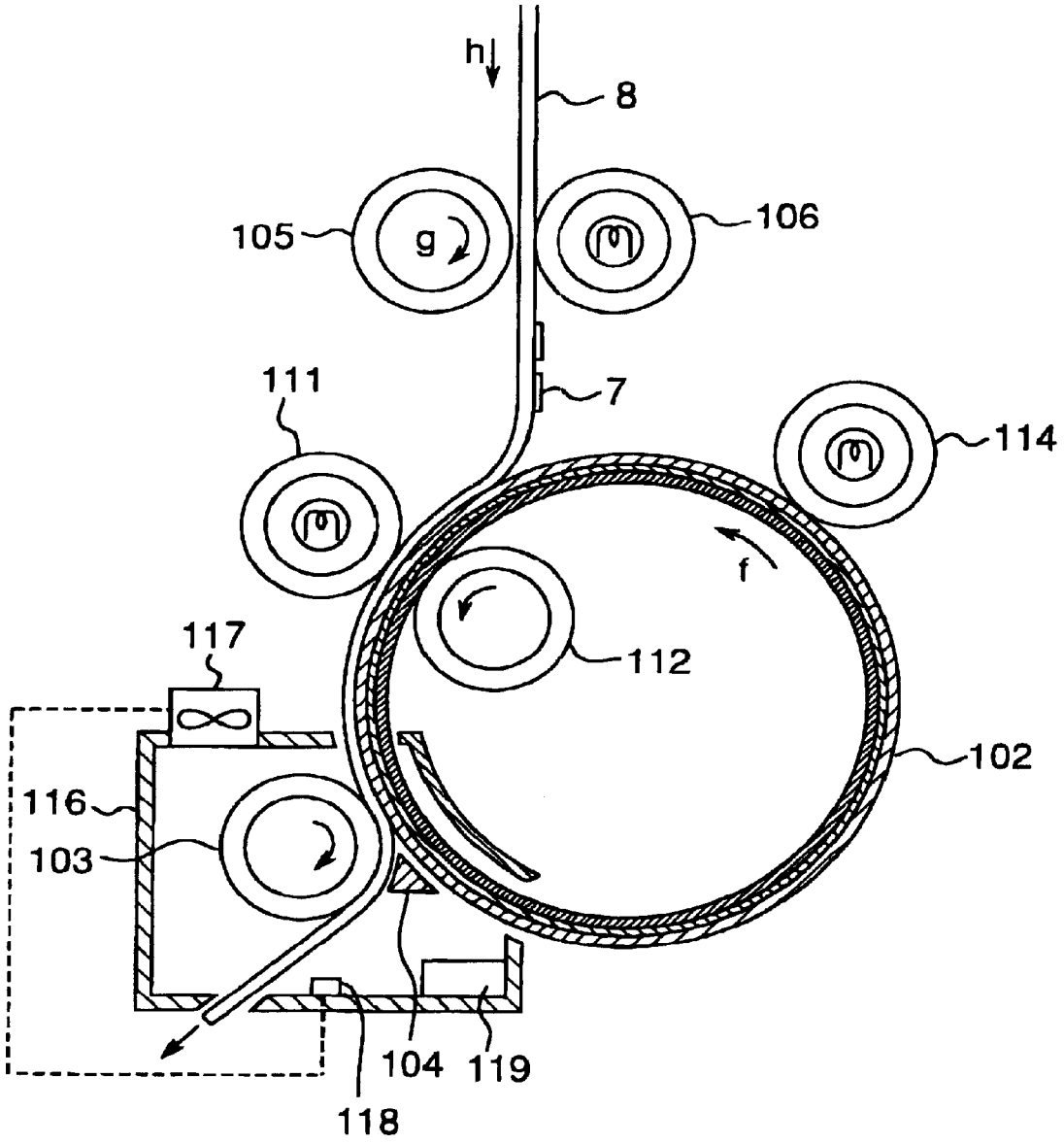
FIG. 6 is a view showing a third embodiment of the printing material removing apparatus of the present invention.

FIG. 6 shows a third embodiment of the printing material removing apparatus of the present invention.

In this embodiment, the separation part is surrounded by a heat insulating wall 116. On the heat insulating wall 116 is provided a fan 117 for emitting the heat within the heat insulating wall 116 to the outside. The fan 117 may be always driven in the course of operation of the apparatus, though it may be driven when a temperature sensor 118 provided on the heat insulating wall 116 detects a predetermined temperature, for example, a temperature of more than 80° C. In addition to the fan 117, a cooling element 119, for example, Peltier effect element can be provided as a cooling means. The cooling element 119 is preferably operated when the temperature sensor 118 detects a predetermined temperature, for example, a temperature of more than 80° C. Either the fan 117 or the cooling element 119 may be provided, or alternatively both of them may be provided.

EXAMPLES

Example 1

As the releasing belt 2, there was used one made by coating the outer surface of a nickel sleeve having a thickness of 200 μm and a circumferential length of 700 mm with a resin of the same components as those of the toner in a thickness of 2 μm by using a FINE WRITER 401 (electrophotographic laser beam printer) made by MINOLTA CO., LTD. and storing said sleeve in a high temperature bath at 150° C. for an hour to smooth the surface.

As the recording member 8, there was used a white PET film made by dispersing the fine particles of titanium oxide therein. An image of toner 7 is formed on the recording member 8 with the FINE WRITER 401. As the toner 7, there was used one having the softening point at 120° C. and SP value of 10.5.

The above releasing belt 2 was set on the apparatus of FIG. 1 and said releasing belt 2 was moved at a speed of 15 mm/sec. On the other hand, the recording member 8 was supplied by the paper feed roller 1 at a speed of 15 mm/sec. The heating roller 11 of the releasing belt 2 was kept at a temperature of 150° C. The separation roller 3 having a diameter of 16 mm which was smaller than that of the driving roller 9 (diameter, 40 mm) of the releasing belt 2 was used and maintained at 60° C.

When the apparatus was operated under the above conditions, the recording member 8 was smoothly released from the releasing member surface layer 23 with the toner 7 cleanly removed, and became re-usable.

Example 2

As the releasing drum 102, there was used an aluminum drum having the wall thickness of 1 mm, and the diameter of 120 mm. The approximate constitution was a single layer as in FIG. 3A.

As the recording member 8, there was used the same material as that of Example 1.

Using the above releasing drum 102 for the apparatus of FIG. 5, the drum was rotated at a speed of 15 mm/sec., and on the other hand, the recording member 8 was supplied at a speed of 15 mm/sec. by the paper feed roller. The heating roller 111 of the releasing drum 102 having a diameter of 30 mm was used and kept at a temperature of 150° C. The separation roller 103 having a diameter of 60 mm which was smaller than that of the releasing drum (120 mm in diameter) was used and maintained at 60° C.

When the apparatus was operated in the above conditions, the recording member 8 was smoothly separated from the releasing drum 102 with the toner 7 cleanly removed, and became re-usable.

Comparative Example

Except that the diameter of the separation roller 3 was made to be 40 mm in the same size as that of the driving roller 9 of the releasing belt 2, the toner removing process was made in the same manner as that of Example 1. As a result, the resin on the releasing member surface layer 23 adhered to the recording member 8 side, and the recording member 8 could not be accepted as a re-usable recording member 8.

As a result of the above examples and comparative example, according to the printing material removing apparatus of the present invention, it has been confirmed that, by making the radius of curvature of the recording member 8 smaller than the radius of curvature of the releasing member surface layer 23, favorable separation of the recording member 8 from the releasing member surface layer 23 can be attained.

Fourth Embodiment

Figure 7:
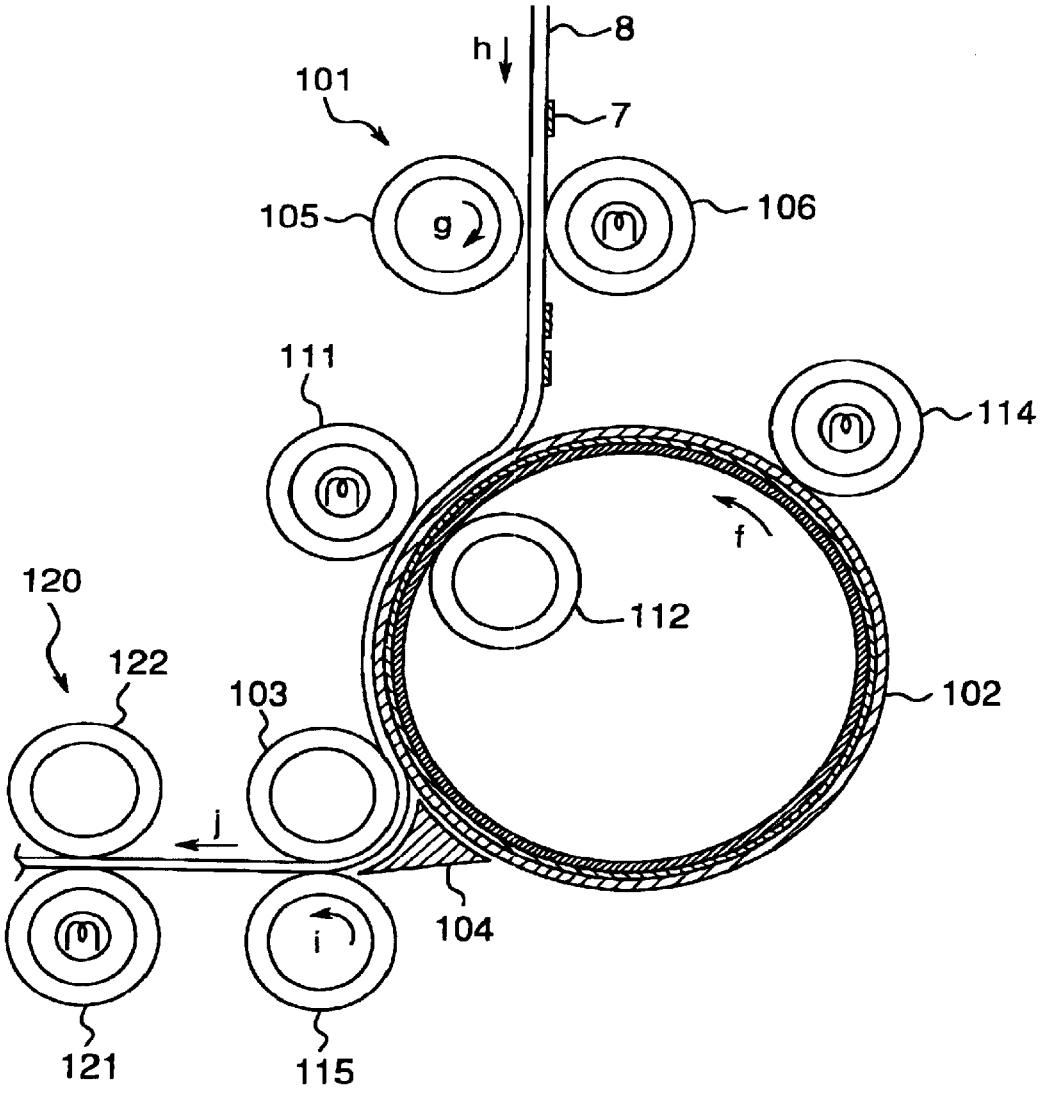
FIG. 7 is a view showing a fourth embodiment of the printing material removing apparatus of the present invention.

FIG. 7 shows a fourth embodiment of the printing material removing apparatus of the present invention.

This embodiment is arranged in addition to the second embodiment as shown in FIG. 5 so as to prevent traces of image from remaining on the recording member after removing the printing material.

Figure 8A:
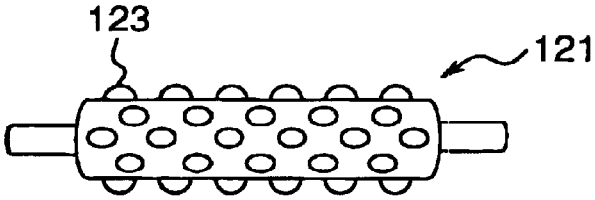
FIG. 8A is a perspective view showing an example of heating roller with roughness in the surface.
Figure 8B:
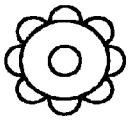
FIG. 8B is a side view of FIG. 8A.
Figure 9A:
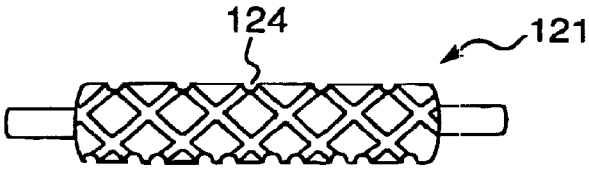
FIG. 9A is a perspective view showing an another example of heating roller with roughness in the surface.
Figure 9B:
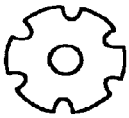
FIG. 9B is a side view of FIG. 9A.
Figure 10A:
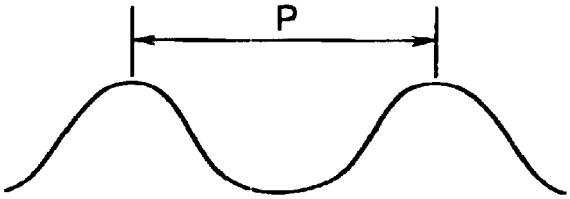
FIGS. 10A and 10B are diagrams showing a pitch and a fluctuation of roughness of the heating roller respectively.
Figure 10B:
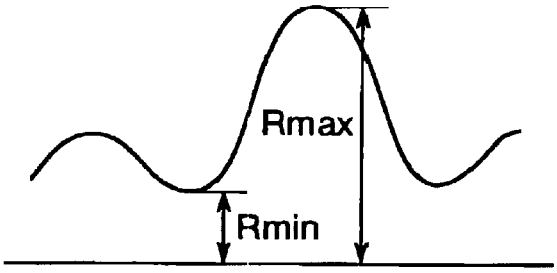

On the left side of the separation roller 103, there is provided an image traces unvisualizing portion 120. The image traces unvisualizing portion 120 comprises a heating roller 121 which comes into contact with the image side surface of the recording member 8 and a backup roller 122 which comes into pressure contact with the heating roller 121. The heating roller 121 is possible to heat the recording member 8 at a temperature of 120° C. The surface of the heating roller 121 may be either smooth or may be formed with roughness by a plurality of small projections 123 as shown in FIGS. 8A and 8B or a plurality of grooves 124 intersecting each other as shown in FIGS. 9A and 9B.

It is preferable that the roughness of the heating roller 121 has a fluctuation of Rmax−Rmin=0–500 μm, where Rmax is a maximum height from the reference surface and Rmin is a minimum height from the reference surface. If the fluctuation is larger than 500 μm, then roughness is also formed on the recording member 8. Thereby, when using the recording member 8 as a copying sheet in a copying machine, toner image on the photoreceptor would not be well transferred to the sheet at the transfer portion of the copying machine, resulting in distortion of the image.

It is also preferable that the roughness of the heating roller 121 has a pitch of P=0.2–4 mm. If the pitch of the roughness is less than 0.2 mm, then the surface has a little roughness and becomes almost smooth, thereby the recording member 8 would not be formed with rough pattern. If the pitch of the roughness is more than 4 mm, then the image traces and the rough pattern formed by the roughness of the heating roller 121 becomes clearly distinguishable, causing the image traces to be read out.

The recording member 8 from which the printing material 7 is removed by the same process as that in the second embodiment is discharged in the direction of arrow "j" and passes between the heating roller 121 and the backup roller 122 of the image traces unvisualizing portion 120. In this portion, the image traces on the recording member 8 is unvisualized by the heating roller 121.

Namely, a pattern corresponding to the roughness formed on the heating roller 121 is overlapped on the image traces, which makes it difficult to read the image traces. Alternatively, the image traces is flattened by the smooth heating roller 121. As a result, even though the recording member 8 before being treated is secret documents, the image traces is unvisualizes, preventing the secret information from leaking out.

By the above-described unvisualizing process roughness remains on the recording member. When reusing the recording member as copying sheet in an image forming apparatus of electro-photographic system, the roughness of the sheet is almost eliminated after passing through the fixation device of the image forming apparatus, thereby the image is formed without any troubles.

Figure 11:
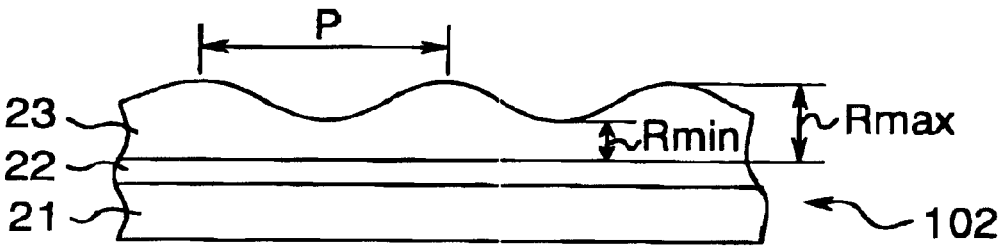
FIG. 11 is a view showing an example of releasing drum with roughness in the surface.
Figure 12:
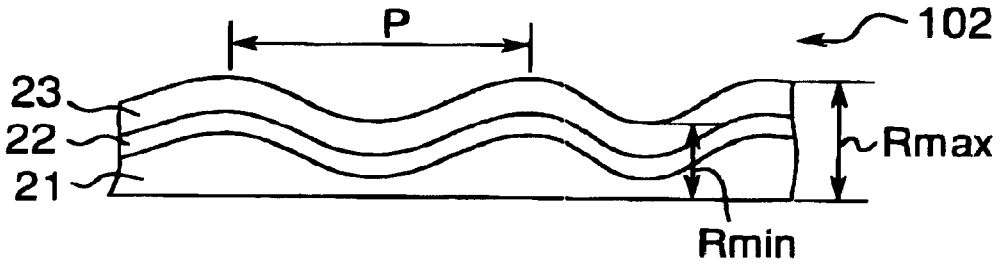
FIG. 12 is a view showing an another example of releasing drum with roughness in the surface.

FIGS. 11 and 12 are variations of the fourth embodiment as shown in FIG. 7.

Although in the above-described fourth embodiment the image traces unvisualizing portion 120 is arranged so that the recording member 8 passes through it after removing the toner 7, it is also possible to provide an image traces unvisualizing means in the pressure contact part of the releasing drum 102 by forming roughness on the releasing member surface layer 23 of the releasing drum 102. In particular, by forming roughness on the surface -of the heating roller 114, the roughness on the releasing member surface layer 23 of the releasing drum 102 can be formed as shown in FIG. 11 when the heating roller 114 comes into contact with the releasing drum 102. Alternatively, by forming roughness on the surface of the base layer 21 of the releasing drum 102 in advance, the roughness comes into existence on the releasing member surface layer 23 as shown in FIG. 12 when the releasing member surface layer 23 is applied on the base layer 21 via the adhesive layer 22.

In these cases, it is preferable that the roughness of the releasing drum 102 has a fluctuation of Rmax−Rmin=6–200 μm. If the fluctuation is less than 6 μm, the recording member 8 would not be formed with preferable rough pattern. If the fluctuation is more than 200 μm, contact of the releasing member surface layer 23 to the recording member 8 becomes insufficient, which makes it difficult to satisfactorily remove the toner 7 from the recording member 8.

It is also preferable that the roughness of the releasing drum 102 has a pitch of P=0.5–4 mm. If the pitch of the roughness is less than 0.5 mm, then there is a high possibility that the recording member 8 and the releasing member surface layer 23 do not come into well contact with each other, whereby the toner 7 at that part remains unremoved from the recording member 8. If the pitch of the roughness is more than 4 mm, then the image traces and the rough pattern formed by the roughness of the releasing drum 102 becomes clearly distinguishable, causing the image traces to be read out.

It is also preferable that the roughness of the releasing drum 102 is smooth and have no step-like fluctuation.

The image traces unvisualizing means is not limited to the above-described embodiments. The roughness may be formed on the preheating roller 106 on upstream side of the pressure contact part, the heating roller 111 of the pressure contact part and the discharge roller 115 of the separation part. The surface of the heating roller 121, preheating roller 106, the heating roller 111 and the discharge roller 115 as the image traces unvisualizing means preferably comprises a material of high releaseability, for example, silicon resin, fluororesin and so on.

EXAMPLES

Example 3

As the releasing drum 102, there was used ore made by coating the outer surface of a PET film drum having a thickness of 1 mm with a resin of the same components as those of the toner in a thickness of 2 μm by using a FINE WRITER 401 (electrophotographic laser beam printer) made by MINOLTA CO., LTD. and storing said drum in a high temperature bath at 150° C. for an hour to smooth the surface.

As the recording member 8, there was used a white PET film made by dispersing the fine particles of titanium oxide therein. An image of toner 7 is formed on the recording member 8 with the FINE WRITER 401. As the toner 7, there was used one having the softening point at 120° C.

The above releasing drum 102 was set on the apparatus of FIG. 7 and said releasing drum 102 was rotated at a speed of 15 mm/sec. On the other hand, the recording member 8 was supplied by the paper feed roller 101 at a speed of 15 mm/sec. The heating roller 111 of the releasing drum 102 was kept at a temperature of 150° C. On the downstream side of the separation roller 103, the heating roller 121 with the roughness formed on the surface was provided as the image traces unvisualized means and heated at a temperature of 150° C.

As a result, the toner 7 was cleanly removed from the recording member 8, and the latter became re-usable. On the surface of recording member 8 the roughness pattern was formed, which made it difficult to read out the image before toner removing process.

Fifth Embodiment

Figure 13:
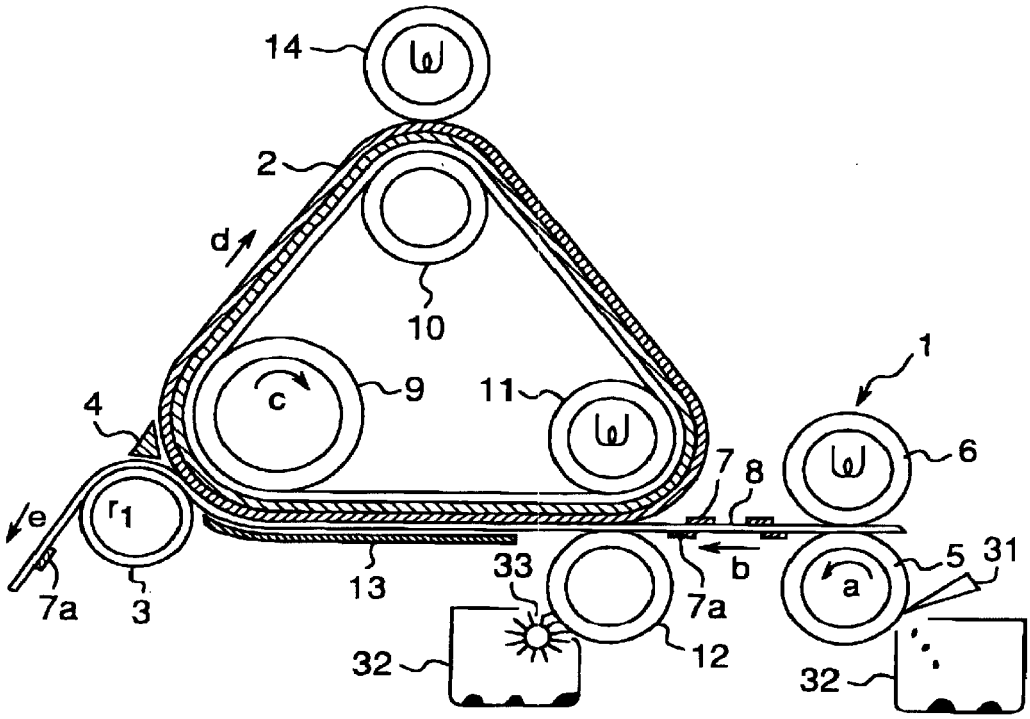
FIG. 13 is a view showing a fifth embodiment of the printing material removing apparatus according to the present invention.

FIG. 13 shows a fifth embodiment of the printing material removing apparatus of the present invention.

Figure 14A:
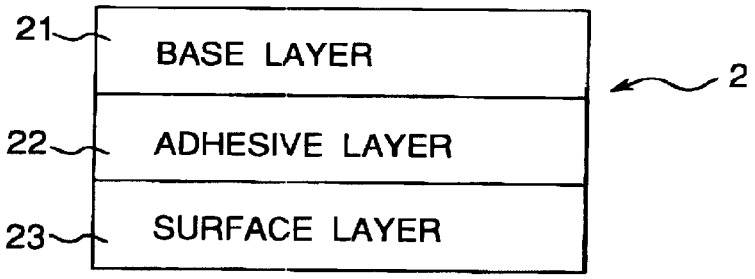
FIGS. 14A and 14B are schematic views showing the structure of the recording member and the releasing member respectively.
Figure 14B:
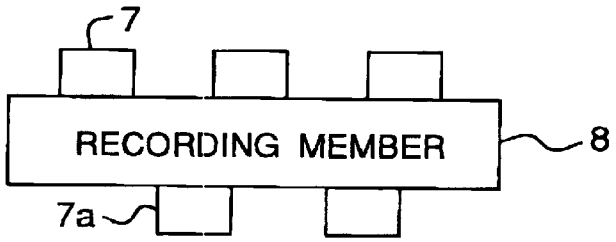

This embodiment and the next sixth embodiment described hereinafter eliminate the inconvenient when using a recording member 8 with images formed on both surfaces thereof as shown in FIG. 14B in each of the above-described embodiments.

The driving roller 5 is a backup roller for the preheating roller 6. The surface of the driving roller 5 as a backup roller is made of a material having a small hydrophilic property, i.e., a contact angle of more than 90 degree to the water, for example, silicon resin, fluororesin such as Teflon® and so on.

The surface of the backup roller 12 is made of a material having a small hydrophilic property, i.e., a contact angle of more than 90 degree to the water, for example, silicon resin, fluororesin such as Teflon® and so on in the same manner as the driving roller 5.

The driving roller 5 of the feed roller 1 is provided with a blade 31 which comes into pressure contact with the surface of the driving roller 5 to scrape the adhesion material (printing material 7*a*) off, and a container 32 for recovering the printing material 7*a* scraped off by the blade 31. Instead of the blade 31, a cleaning means, i.e., a suction device for sucking the adhesion material on the driving roller 5, a brush (for example, fur brush or nylon brush) for removing the adhesion material on the driving roller 5, and so on may he used. In the same way as the driving roller 5, the backup roller 12 of the releasing belt 2 is provided with a rotation brush 33 which comes into pressure contact with the surface of the driving roller 5 to remove the adhesion material (printing material 7*a*) off, and a container 32 for recovering the printing material 7*a* removed by the rotation brush 33. Instead of the rotation brush 33, a cleaning means as described above, i.e., a suction device, a blade and so on may be used.

When the recording member 8 passes through the preheating roller 6 and the heating roller 11, not only the printing material 7 on the treating surface of the recording member 8 but also the printing material 7*a* on the non-treating surface thereof. However, the driving roller and the backup roller 12 which come into pressure contact with the preheating roller 6 and the heating roller 11 respectively are made of a material having a small hydrophilic property, i.e., a contact angle of more than 90 degree to the water. Therefore, even if the printing material 7*a* melts, it hardly adheres to the driving roller 5 and backup roller 12, preventing lack or disturbance of the image of the non-treating surface of the recording member 8. Moreover, the clean surface of the recording member 8 to be subsequently treated is not soiled. In case that the printing material 7*a* adhered to the driving roller 5 or backup roller 12, the printing material 7*a* is scraped off by the blade 31 or removed by the rotation brush 33 and recovered to the containers 32.

In the above-described embodiment, the surface of the guide plate 13 and separation roller 3 opposed to the non-treated surface of the recording member 8 and the heating roller 14 for heating the releasing belt 2 may be also made of releasable material.

Sixth Embodiment

Figure 15:
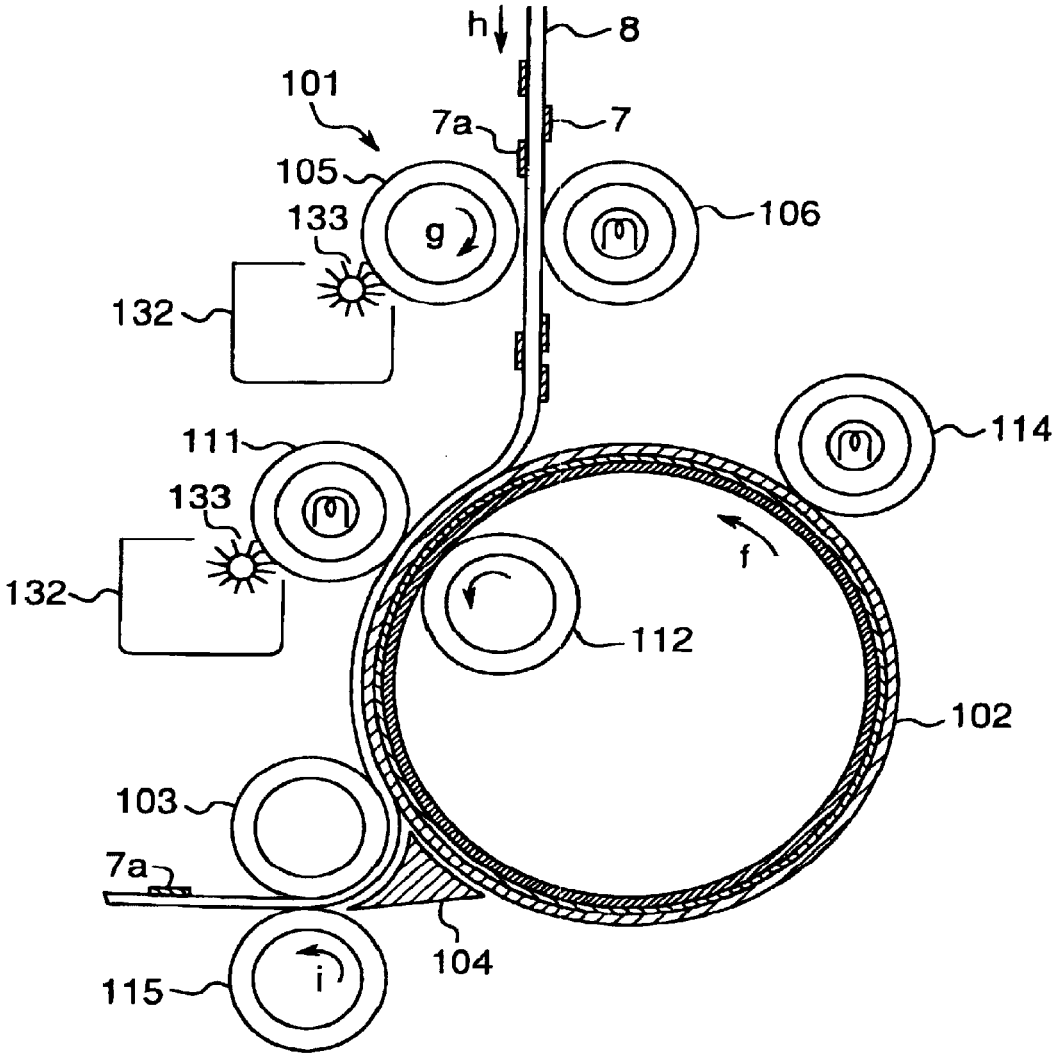
FIG. 15 is a view showing a sixth embodiment of the printing material removing apparatus of the present invention.
Figure 16:
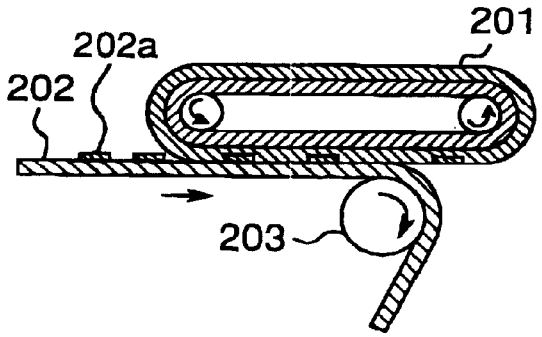
Fig.16 PRIOR ART
FIG. 16 is a view showing an example of the conventional printing material removing apparatus.
Figure 17:
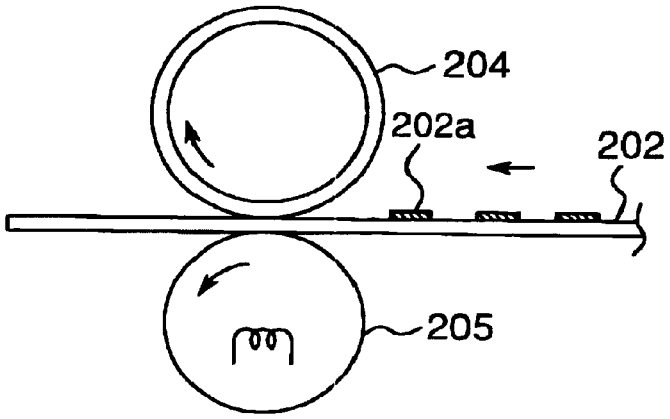
Fig.17 PRIOR ART
FIG. 17 is a view showing other example of the conventional printing material removing apparatus.
Figure 18:
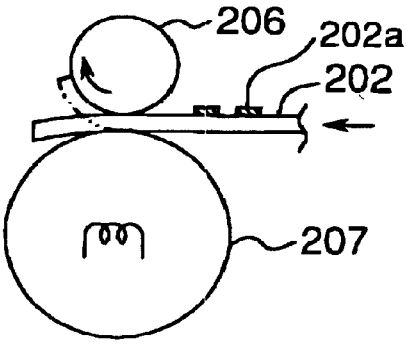
Fig.18 PRIOR ART
FIG. 18 is a view showing still other example of the conventional printing material removing apparatus.
Figure 19A:
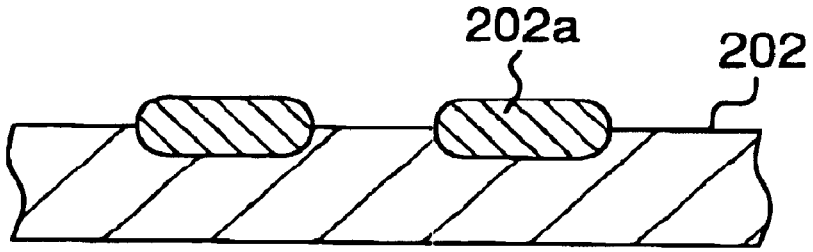
Fig. 19A PRIOR ART
FIGS. 19A and 19B are views showing a state of printing material fixed to the recording member and a trace of printing material removed from the recording member.
Figure 19B:
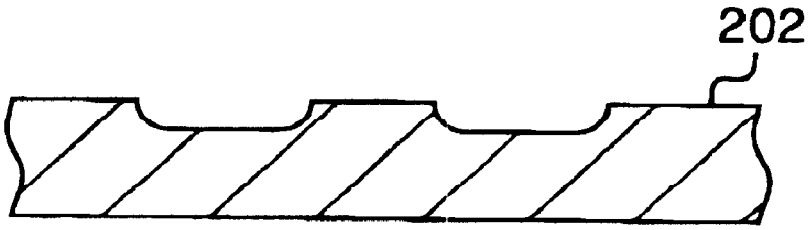
Fig. 19B PRIOR ART

FIG. 15 shows a sixth embodiment of the printing material removing apparatus of the present invention.

The driving roller 105 is a backup roller for the preheating roller 106. The surface of the driving roller 105 as a backup roller is made of a material having a small hydrophilic property, i.e., a contact-angle of more than 90 degree to the water, for example, silicon resin, fluororesin such as Teflon® and so on. The driving roller 105 is provided with a rotation brush 133 which comes into pressure contact with the surface of the driving roller 105 to scrape the adhesion material (printing material 7*a*) off, and a container 132 for recovering the printing material 7*a* scraped off by the rotation brush 133. Instead of the rotation brush 133, a cleaning means, i.e., a suction device, a blade and so on.

The present embodiment is different from the embodiment as shown in FIG. 13 in that the toner 7*a* of the non-treated surface of the recording member 8 does not come into contact with the backup roller 112 but the heating roller 111. Therefore, the surface of the heating roller 111 is made of a material having a small hydrophilic property, i.e., a contact angle of more than 90 degree to the water, for example, silicon resin, fluororesin such as Teflon® and so on in the same manner as the driving roller 105. The heating roller 111 is provided with a rotation brush 133 which comes into pressure contact with the surface of the heating roller 111 to remove the adhesion material (printing material 7*a*) off, and a container 132 for recovering the printing material 7*a* removed by the rotation brush 133. Instead of the rotation brush 133, a cleaning means as described above, i.e., a suction device, a blade and so on may be used.

The printing material removing apparatus comprising the above constitution, especially the driving roller 105, the heating roller 111, the rotation brush 133 and the container 132 shows the same operation as that of the printing material removing apparatus of the embodiment shown in FIG. 13, and therefore the explanation is omitted.

In the above-described embodiment, the surface of the separation roller 103 opposed to the non-treated surface of the recording member 8 and the heating roller 114 for heating the releasing drum 102 may be also made of releasable material.

EXAMPLES

Example 4

As the releasing drum 102, there was used one made by coating the outer surface of a PET film drum having a thickness of 1 mm with a resin of the same components as those of the toner in a thickness of 2 μm by using a FINE WRITER 401 (electrophotographic laser beam printer) made by MINOLTA CO., LTD. and storing said drum in a high temperature bath at 150° C. for an hour to smooth the surface.

As the recording member 8, there was used a white PET film made by dispersing the fine particles of titanium oxide therein. Images of toner 7, 7*a* are formed on the both surfaces of the recording member 8 with the FINE WRITER 401. As the toner 7, 7*a*, there was used one having the softening point at 120° C. When the B/W ratios of the images was measured with Adobephotoshop® made by ADOBE SYSTEM company, it was 5%.

The above releasing drum 102 was set on the apparatus of FIG. 15 and said releasing drum 102 was moved at a speed of 15 mm/sec. On the other hand, the recording member 8 was supplied by the paper feed roller 101 at a speed of 15 mm/sec. The heating roller 111 of the releasing drum 102 was kept at a temperature of 150° C. The surface of the heating roller 111 was coated with Teflon® having a contact angle of 110 degree to the water. The recording member 8 was cooled at the separation part at 60° C. In this example, the brush 133 was detached.

As a result, the recording member 8 was smoothly released from the releasing member surface layer 23 with the toner 7 cleanly removed, and became re-usable. In order to make sure whether or not the toner is adhered to the surface of the heating roller 111, a book tape (Scotch® tape No. 845 made by 3M company) was adhered to a 5 cm square portion of the surface of the heating roller 111 and peeled. When the B/W ratio of the adhesive surface of the tape was measured with Adobephotoshop®, it was 0.01%. It was considered that the toner was not adhered to the surface of the heating roller 111 at all. When the B/W ratio of the non-treated surf ace of the recording member 8 was also measured it was the same 5% as that before treating the recording member 8 by the apparatus and no disturbance of the image was recognized.

Comparative Example

Except that the surface of the heating roller 111 was coated with polyethylene terephthalate having a contact angle of 67 degree to the water, the toner removing process was made in the same manner as that of Example 1. As a result, the B/W ratio of the surface of the heating roller 111 was 0.3%, i.e., at a level that the toner adhered to the surface of the heating roller 111 was visually recognized. The B/W ratio of the non-treated surface of the recording member 8 was slightly reduced to 4.7%. Lack of the image on the non-treated surface of the recording member 8, and adhesion of the toner to thereon which was not seen before treating the recording member 8 by the apparatus was also visually recognized.

Example 5

The same experiment as the example 1 was repeated 1,000 times. As a result, no lack and no disturbance of the image on the non-treated surface of the recording member 8 were not recognized. The B/W ratio of the surface of the heating roller 111 was 0.1%.

Then, in a condition that the nylon rotation brush 133 having an outside diameter of 16 mm was provided so that it made contact with the heating roller 111 and rotated at a speed of 30 mm/sec, the same experiment was repeated more 10,000 times. As a result, no lack and no disturbance of the image on the non-treated surface of the recording member 8 were not recognized. The B/W ratio of the surface of the heating roller 111 was 0.01% and acceptable.

Comparative Example

Except that the surface of the heating roller 111 was coated with polyethylene terephthalate having a contact angle of 67 degree to the water and that the rotation brush 133 was operated from the beginning, the toner removing process was made in the same manner as that of Example 2. After the treatment of 1,000 times, in spite of cleaning means the B/W ratio of the surface of the heating roller 111 was 3.5%, i.e., at a level that the toner adhered to the surface of the heating roller 111 was visually recognized.

Although the present invention has been fully described by way of the examples with reference to the accompanying drawing, it is to be noted that here that various changes and modifications will be apparent to those skilled in the art. Therefore, unless such changes and modifications otherwise depart from the spirit and scope of the present invention, they should be construed as being included therein.

What is claimed is:

1. An apparatus for removing printing material from a recording member on which an image is recorded by the printing material, comprising:

a releasing member which comes into pressure contact with the recording member to adhere to the printing material on the recording member, said releasing member being formed so as to have a predetermined radius of curvature at a separation point where the recording member is separated from the releasing member;

a moving device which moves the releasing member in a direction toward the separation point; and a bending member which bends the recording member in a direction opposite to the releasing member so that the recording member has a radius of curvature smaller than the radius of curvature of the releasing member at the separation point, wherein the recording member, which is in pressure contact with the releasing member, is moved in accordance with movement of the releasing member and bent by the bending member to separate from the releasing member at the separation point, thereby the printing material is removed from the recording member by being transferred to the releasing member.

2. The apparatus as in claim 1, wherein the ratio between the radius of curvature R1 of the recording member at the separation point and the radius of curvature R2 of the releasing member at the separation point is 1:10 to 8:10.

3. The apparatus as in claim 1, wherein the releasing member comprises a belt-like member which is borne on a plurality of rollers and rotated by the moving device, the bending member comprises a separation roller which is opposed to one of the plurality of rollers and has a smaller diameter than said one of the plurality of rollers.

4. The apparatus as in claim 1, wherein the releasing member comprises a drum-like member which is rotated by the moving device, the bending member comprises a separation roller which is opposed to the drum-like member and has a smaller diameter than the drum-like member.

5. The apparatus as in claim 1, wherein the releasing member comprises a base layer and a surface layer provided on the base layer, the surface layer is made of a material adhereable to the printing material.

6. The apparatus as in claim 5, wherein the material has a solubility parameter value between 8 and 12.

7. The apparatus as in claim 5, wherein the material has a softening point between 80° C. and 200° C.

8. The apparatus as in claim 1, wherein the releasing member has a single layer constitution.

9. The apparatus as in claim 8, wherein the releasing member is metal.

10. The apparatus as in claim 1, further comprising an image trace removing means for removing said an image trace after removing the printing material.

11. The apparatus as in claim 10, wherein the image trace removing means is a roller which comes into contact with the recording member.

12. The apparatus as in claim 11, wherein the surface of the roller has roughness.

13. The apparatus as in claim 11, wherein the surface of the roller is smooth.

14. The apparatus as in claim 11, wherein the roller is a heating roller.

15. The apparatus as in claim 10, wherein the image trace removing means is roughness formed on the releasing member.

16. The apparatus as in claim 1, further comprising a backup member provided so as to face to an opposite surface to a treating surface of the recording member, the surface of the backup member comprising a releasable material.

17. The apparatus as in claim 16, wherein the backup member is a roller.

18. The apparatus as in claim 17 further comprising a cleaning means for removing an adhesion material on the roller.

19. The apparatus as in claim 16 wherein the backup member is a guide for guiding the recording member to the separation point.

20. A method for removing printing material from a recording member on which an image is recorded by the printing material, comprising the steps of:

making releasing member come into pressure contact with the recording member to make it adhere to the printing material on the recording member, said releasing member being formed so as to have a predetermined radius of curvature at a separation point where the recording member is separated from the releasing member;

moving the releasing member in a direction toward the separation point; and bending the recording member in a direction opposite to the releasing member so that the recording member has a radius of curvature smaller than the radius of curvature of the releasing member at the separation point, wherein the recording member, which is in pressure contact with the releasing member, is moved in accordance with movement of the releasing member and bent to separate from the releasing member at the separation point, thereby the printing material is removed from the recording member by being transferred to the releasing member.

* * * * *